United States Patent [19]

Sugiura

[11] 4,323,807

[45] Apr. 6, 1982

[54] LOCK STRUCTURE FOR INTEGRATING A CABINET COVER AND A BOTTOM PLATE

[75] Inventor: Shigekata Sugiura, Soma, Japan

[73] Assignee: Alps Electric Co., Ltd., Tokyo, Japan

[21] Appl. No.: 183,192

[22] Filed: Sep. 2, 1980

[30] Foreign Application Priority Data

Sep. 4, 1979 [JP] Japan ..... 54/122194

[51] Int. Cl.[3] ..... A47B 81/06; E05F 1/00; B65D 45/00

[52] U.S. Cl. ..... 312/284; 312/208; 312/7.1; 220/326; 16/172; 16/DIG. 13; 16/257; 292/DIG. 38

[58] Field of Search ..... 312/284, 7 R, 208; 292/DIG. 38, 31; 220/4 F, 326; 16/DIG. 13, 172

[56] References Cited

U.S. PATENT DOCUMENTS

| | | | |
|---|---|---|---|
| 1,858,778 | 5/1932 | Horton | 312/284 |
| 2,223,284 | 11/1940 | Handley et al. | 16/172 |
| 3,281,936 | 11/1966 | DeHaan et al. | 220/326 |
| 3,422,358 | 1/1969 | Sabonis | 312/7 R |
| 3,553,585 | 1/1971 | Robertson et al. | 312/7 R |
| 3,996,430 | 12/1976 | Eberwein et al. . | |
| 4,214,797 | 7/1980 | Borresen et al. | 312/284 |
| 4,223,787 | 9/1980 | Lowry et al. | 292/DIG. 38 |
| 4,286,124 | 8/1981 | Guttmann | 312/7 R |

*Primary Examiner*—Victor N. Sakran

*Attorney, Agent, or Firm*—Guy W. Shoup; Gerard F. Dunne

[57] ABSTRACT

A lock structure especially useful for locking a cabinet cover to a bottom plate makes it possible to integrate and separate the cabinet cover and the bottom plate quite easily, and also secures the cabinet cover and the bottom plate quite tightly to prevent any play between the two.

3 Claims, 6 Drawing Figures

LOCK STRUCTURE FOR INTEGRATING A CABINET COVER AND A BOTTOM PLATE

BACKGROUND OF THE INVENTION

This invention relates to a lock structure for integrating a cabinet cover and a bottom plate together.

A cabinet accommodating therein electric/electronic components such as a printed circuit board generally consists of a cabinet cover and a bottom plate that are separably molded, and push buttons, switches and the like are fitted to the surface of the cabinet cover. Manipulation of these push buttons and switches applies a desired signal or instruction to the electric circuit portion. In such a cabinet, the following requirements (1) through (4) must be satisfied.

(1) The cabinet and the bottom cover should be integrated together easily.

(2) No play should occur after they are integrated.

(3) Separation between the cabinet cover and the bottom plate should be made easily.

(4) The structure should be simple.

However, none of the conventional lock structures have succeeded in perfectly satisfying all of these requirements. Most of them involve the drawback that the integration is easy, by separation is difficult, or vice versa, for example.

SUMMARY OF THE INVENTION

An object of the present invention is to provide a lock structure which is simple in construction, is capable of easily integrating and separating the cabinet cover and the bottom plate and eliminates play once the cabinet cover and the bottom plate are integrated.

Another object of the present invention is to provide a lock structure which can be produced economically on a mass basis by plastic molding.

According to the invention, mating structures are provided for resiliently holding the cabinet together, and rod-like structures projections are also provided for easing separation of these.

These and other objects, as well as advantageous features, of the invention will become clear from the following description of the invention taken in conjunction with the accompanying drawings.

In these drawings portions associated with the lock are illustrated but other members and components such as switches and push buttons to be fitted to the cabinet or other electric/electronic components are not shown.

DESCRIPTION OF THE PREFERRED EMBODIMENT

Figure 1:
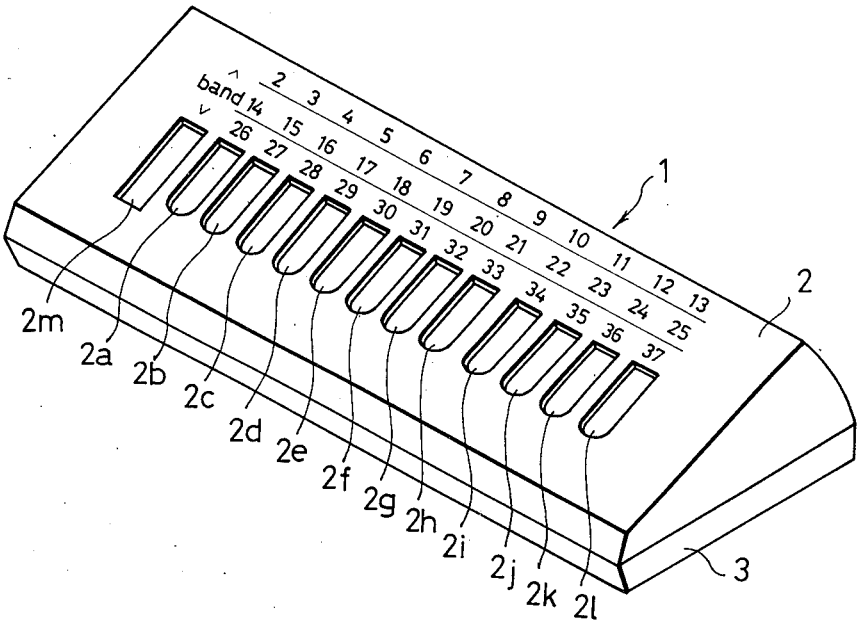
FIG. 1 is a perspective view of a cabinet to which the lock structure in accordance with the present invention can be applied.

In FIG. 1, reference numeral 1 represents a plastic cabinet for accommodating therein a tuner for VHF and UHF channels in a television receiver and reference numeral 2 represents a cabinet cover equipped with apertures 2*a*, 2*b*, . . . and 2*l* for the insertion of channel selection push buttons, and with an aperture 2*m* for the insertion of a band selecting switch. Reference numeral 3 represents a bottom plate. The cabinet cover 2 and the bottom plate 3 are shaped in a box-like form and when integrated together, they define a hollow space between them for accommodating electric/electronic components such as a printed circuit board.

Figure 2:
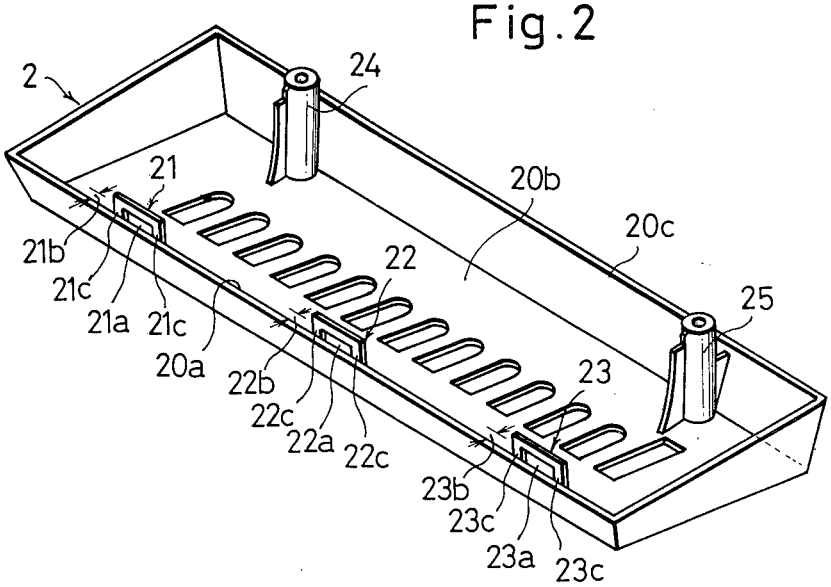
FIG. 2 is a perspective view of the interior of the cabinet cover.

In FIG. 2, reference numerals 21, 22 and 23 represent latch members each having a sheet-like form and resiliency. These latch members have rectangular anchor holes 21*a*, 22*a* and 23*a* formed in the upper central portions, respectively, and are integrally provided on the ceiling portion 20*b* of the cabinet cover 2 in such a fashion that gaps 21*b*, 22*b* and 23*b* about 2 mm wide are present with respect to the frame side wall 20*a* of the cabinet cover 2, respectively (see FIG. 4). Reference numerals 24 and 25 represent anchor protuberances that are integrally provided to the ceiling portion 20*b*, and are adapted to engage with cylindrical anchor portions on the bottom plate 3, which anchor portions will be described later, and tightly fix the cabinet cover 2 to the bottom plate 3. All of the cabinet cover 2, latch members 21–23 and anchor protuberances 24 and 25 are integrally molded by molding a plastic inside molding die.

Figure 3:
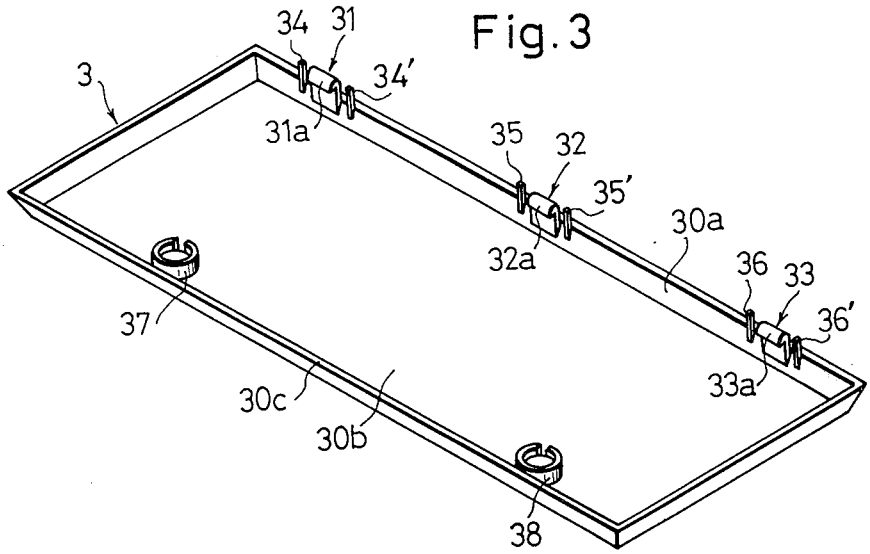
FIG. 3 is a perspective view of the interior of the bottom plate.

In FIG. 3, reference numerals 31, 32 and 33 represent anchor pawls that are provided on the frame side wall 30*a* of the bottom plate 3 and have hook-like protuberances 31*a*, 32*a* and 33*a* at their tips, respectively. These protuberances 31*a*–33*a* are adapted to fit within anchor holes 21*a*–23*a* formed on the latch member 21–23, respectively (see FIG. 2). Reference numerals 34, 34', 35, 35', 36 and 36' represent respective lock-releasing pawls each formed in the shape of a rod. When the cabinet cover 2 is to be separated from the bottom plate 3, these pawls 34–36' deflect the latch members 21–23 and facilitate the release of the engagement between the anchor pawls 31–33 and the latch members 21–23, as described below.

Reference numerals 37 and 39 represent respective cylindrical fitting portions. These fitting portions are formed on the bottom portion 30*b* of the bottom plate 3 and are integrated therewith. Further, they are adapted to engage tightly with the anchor protuberances 24 and 25 formed at the ceiling portion 20*b* of the cabinet cover 2, respectively, and tightly fix the cabinet cover 2 to the bottom plate 3. All of the bottom plate 3, anchor pawls 31–33, lock-releasing pawls 34 to 36' and anchor portions 37 and 38 are integrally molded by insert-molding of a plastic using a plastic molding die.

Figure 4:
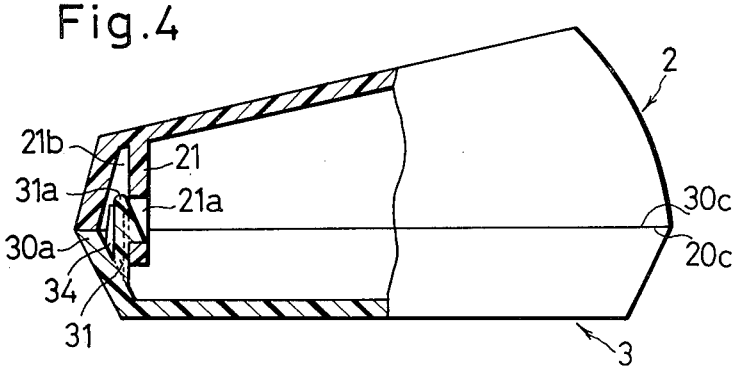
FIG. 4 is a sectional view of the cabinet at the time of lock (or, when it is integrated)
Figure 5:
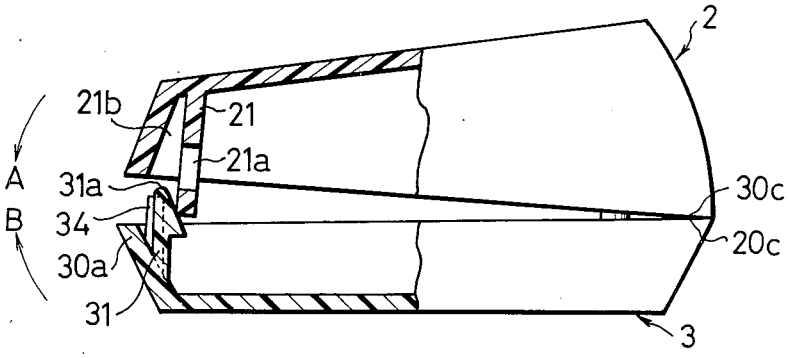
FIG. 5 is a schematic view useful for explaining the locking of the cabinet cover and the bottom plate.
Figure 6:
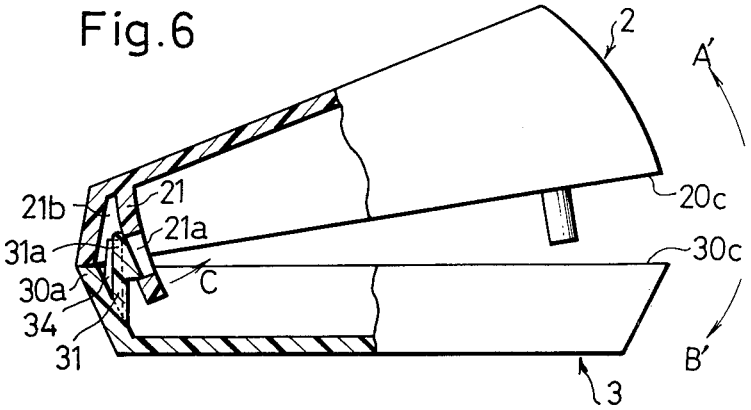
FIG. 6 is a schematic view useful for explaining the separation of the cabinet cover and the bottom plate.

Referring then to FIGS. 4, 5 and 6, lock and separation of the cabinet cover and the bottom plate will be described.

In locking, one of the frame end portions 30*c* of the bottom plate 3 and frame end portion 20*c* of the cabinet cover 2 are abutted together as shown in FIG. 5 and are set in such a manner that each hook-like protuberance 31*a*–33*a* of each anchor pawl 31–33 of the bottom plate 3 and each lock-releasing pawl 34 to 36' enter the corresponding gaps 21*b*–23*b* of the cabinet cover 2. Under this state, when the cabinet cover 2 as well as the bottom plate 3 are pushed in the directions indicated by arrows A and B (see FIG. 5), respectively, the hook-like protuberances 31*a*–33*a* at the tips of the anchor pawls 31–33 start entering the mating gaps 21*b*–23*b* while flexing the latch members 21–23 inwardly. As the cabinet cover 2 and the bottom plate 3 are further pushed in the directions of the arrows A and B, respectively, these protuberances 31*a*–33*a* engage with the anchor holes 21*a*–23*a* formed in the latch members 21–23, respectively. In this instance, the anchor protuberances 24 and 25 (see FIG. 2) at the ceiling portion 20*b* of the cabinet cover 2 fit tightly within the cylindrical anchor portions 37 and 38 (see FIG. 3) on the bottom 30*b* of the bottom plate 3, respectively, whereby the cabinet cover 2 and the bottom plate 3 are locked integrally with each other (see FIG. 4). Incidentally, the lock-releasing pawls 34, 34', 35, 35', 36, 36' enter the gaps 21*b*, 22*b* and 23*b*, respectively, and lie adjacent and the end portions 21*c*, 22*c* and 23*c* of the latch members 21, 22 and 23, respectively.

For separating the cabinet cover 2 from the bottom plate 3, forces in the directions of arrows A' and B' are applied to the frame end portions 20*c*, 30*c* of each of the cabinet cover 2 and the bottom plate 3, respectively, as shown in FIG. 6 so that they open on the hinges formed by the hook-like protuberances engaging the anchor holes of the latch members. In this case, the resilient anchor pawls 31–33 are thus pressed by the respective latch members 21–23, and are bent to some extent towards the frame side wall 30*a*, while the lock-releasing pawls 34, 34', 35, 35', 36, 36' abut respective end portions 21*c*–23*c* of the latch members 21–23 and flex the receiving pawls 21–23 in the direction indicated by arrow C, respectively. Under this state, if the opening forces are further applied in the directions of the arrows A' and B' the hook-like protuberances 31*a*–33*a* formed on the anchor pawls 31–33 disengage from the anchor holes 21*a*–23*a* formed on the latch members 21–23 and the cabinet cover 2 is separated from the bottom plate 3.

In the foregoing description, though two lock-releasing pawls 34, 34', 35, 35', 36, 36', are used, only one lock-releasing pawl may be disposed. Further, the foregoing description deals with the case where the height of the lock-releasing pawls is smaller than that of the anchor pawls, if the height of the lock-releasing pawls is greater than that of the anchor pawls, this arrangement may make it possible to increase the force which the receiving pawls receive at the time of separation, to increase the flexing of the receiving pawls at the time of separation and thus to make the separation easier.

Moreover, in the above-described embodiment, the latching members are provided to the cabinet cover with the anchor pawls on the bottom plate, this arrangement may of course be reversed.

I claim:

1. In a lock structure for integrally locking a cabinet cover to a bottom plate, including first and second sets of co-engaging structures, said first set of co-engaging structure being at least constituted by a concavity and a corresponding covexity each formed on the inner surface of one of said cabinet cover and a facing inner surface of said bottom plate, respectively, said second co-engaging structure being at least constituted by a resilient anchor pawl having at the tip thereof a hook and a resilient latch member having at the center thereof an anchor hole to engage with said hook formed on the inner surface of said cabinet cover and a facing inner surface of said bottom plate, respectively, the improvement comprising a rod-like projection being formed adjacent to said anchor pawl so as to face respective one of said latch member when said second structure is co-engaged and, a gap being defined between said latch members and one frame side wall of said cabinet cover or said bottom plate for receiving said anchor pawl and said rod-like projection when said second structure is co-engaged and, when said cabinet cover and said bottom plate are opened on hinges from the opposite side to said frame side wall, said latch member is flexed by said rod-like projection thereby to release the lock of said second co-engaging structure.

2. A structure according to claim 1, said second co-engaging structure being constituted by a plurality of anchor pawls, latch members and rod-like projections.

3. A structure according to claim 2, said rod-like projections are juxtaposed in such a manner as to clamp said anchor pawls.

* * * * *